US005338143A

United States Patent [19]

Matsuda et al.

[11] Patent Number: 5,338,143

[45] Date of Patent: Aug. 16, 1994

[54] CAR STORAGE APPARATUS FOR CAR CARRIER

[75] Inventors: Yoshitaka Matsuda; Koichi Kondo; Shuhei Kuribayashi; Akiko Noda; Takuya Nakashima; Ryutaro Saito; Kae Tsuji; Hideo Mori; Yoshinori Mori, all of Kobe, Japan

[73] Assignees: Mitsubishi Jukogyo Kabushiki Kaisha, Tokyo; Seiryo Engineering Co., Ltd., Hygo, both of Japan

[21] Appl. No.: 913,954

[22] Filed: Jul. 17, 1992

[30] Foreign Application Priority Data

| | | | |
|---|---|---|---|
| Jul. 22, 1991 | [JP] | Japan | 3-064853[U] |
| Jul. 24, 1991 | [JP] | Japan | 3-065579[U] |
| Oct. 14, 1991 | [JP] | Japan | 3-293712 |
| Oct. 17, 1991 | [JP] | Japan | 3-093241[U] |
| Oct. 22, 1991 | [JP] | Japan | 3-302370 |
| Oct. 29, 1991 | [JP] | Japan | 3-309765 |

[51] Int. Cl.[5] ..... B63B 27/00

[52] U.S. Cl. ..... 414/142.1; 414/245; 414/257

[58] Field of Search ..... 414/142.1, 143.2, 242, 414/243, 244, 245, 233, 257, 259, 260, 254, 256, 239; 104/88, 127

[56] References Cited

U.S. PATENT DOCUMENTS

| | | | |
|---|---|---|---|
| 1,584,080 | 5/1926 | Dinkelberg . | |
| 2,916,166 | 12/1959 | Bigler | 214/16.1 |
| 2,970,705 | 2/1961 | De Witt, Jr. et al. | 214/14 |
| 3,599,815 | 7/1969 | Bianchi | 414/256 |
| 3,846,860 | 11/1974 | Kummerman | 414/143.2 |
| 4,768,914 | 9/1988 | Sing | 414/239 |

FOREIGN PATENT DOCUMENTS

| | | | |
|---|---|---|---|
| 0380711 | 1/1989 | European Pat. Off. . | |
| 0340673 | 4/1989 | European Pat. Off. . | |
| 0004686 | 1/1983 | Japan | 414/143.2 |
| 1125282 | 8/1968 | United Kingdom | 414/142.1 |
| 2229979 | 10/1990 | United Kingdom | 414/259 |

OTHER PUBLICATIONS

Patent Abstracts of Japan, vol. 10, No. 291 (M-522)(2347) Oct. 3, 1986 & JP-A-61 105 288 (Kurushima Dock K.K.).

*Primary Examiner*—David H. Bollinger
*Attorney, Agent, or Firm*—Nixon & Vanderhye

[57] ABSTRACT

This invention relates to a car storage apparatus in a car carrier having a plurality of stages of car storage decks. The car storage apparatus comprises a car loading port installed at the ship side on one of the decks, a loading-/unloading berth extending from the loading port into the ship, elevator shafts extending vertically through the car storage decks, a lifter which is disposed in each elevator shaft and moves up and down with a car being mounted thereon, and conveyors which are installed on the loading/unloading berth, lifters, and car storage decks for transferring a car between them.

7 Claims, 14 Drawing Sheets

CAR STORAGE APPARATUS FOR CAR CARRIER

FIELD OF THE INVENTION AND RELATED ART STATEMENT

This invention relates to a car storage apparatus for car carrier having multi-stage car storage decks.

The conventional car carrier uses a drive-on/drive-off system. Specifically, the conventional car carrier uses a system in which a driver drives a car to be carried into a ship, and moves it to a predetermined storage position on a car storage deck by passing through a ramp way installed in the ship. Then, wheel stops are pushed against the front and rear wheels of each car by a worker to fix the car on the car storage deck.

This conventional car storage system has the following problems:

(1) It takes much time between when a car enters the ship and when it arrives at the storage compartment because a car is moved by a driver passing through a ramp way in the ship.

(2) Manpower is required because a car is driven to a storage position on each deck. Additionally, skilled drivers are required because a car is driven in narrow spaces in the ship.

(3) The work environment in the ship is aggravated by exhaust gas because a car is driven in the ship.

(4) Each car must be fixed by a worker, which requires manpower and much time.

In this conventional system, the car direction sometimes cannot be changed in the ship depending on the loading condition because the space of each car storage deck is fully used for car storage to increase loading efficiency. In such a case, a car is unloaded at the port of delivery by driving the car in the backward direction on the shore ramp through a loading port.

In the drive-off operation in the backward direction, the visibility is poor, so that high skill is required for driving and much time is taken for drive-off operation.

OBJECT AND SUMMARY OF THE INVENTION

An object of this invention is to provide a car storage apparatus for a car carrier which minimizes manual work, requires only low skill, and reduces the generation of exhaust gas.

To this end, according to the present invention, the car storage apparatus in a car carrier having a plurality of stages of car storage decks comprises a car loading port installed at the ship side on one of the decks, a loading/unloading berth extending from said loading port into the ship, elevator shafts extending vertically through said car storage decks, a lifter which is disposed in each elevator shaft and moves up and down with a car being mounted thereon, and conveyors which are installed on the loading/unloading berth, lifters, and car storage decks for transferring a car between them.

According to the present invention, a car is driven by a driver to the loading/unloading berth in the ship, but afterward the car is transferred by conveyers and lifter for storage.

In the car storage apparatus of the present invention, if a turntable is installed on the loading/unloading berth, the storage position of car can be changed.

Also, if an automatic car fixing device is installed at the storage location, which comprises wheel stops, cylinders for pushing the wheel stop toward the wheel of car to be stored, and a hydraulic regulator for operating the cylinders at a proper pressure, the storage operation is further facilitated.

If, instead of the above-described car fixing device, the conveyor on the car storage deck is formed by two sets of two-row conveyors installed at an interval nearly equal to the wheel base of car so that the set of conveyors are inclined in a V shape to accommodate the wheel of car, a special car fixing device is unnecessary.

Also, the conveyor on the car storage deck may be formed by a conveyor having ridges at an interval nearly equal to the wheel base of car, instead of the abovedescribed conveyor. The opposing surfaces of the ridges are formed so as to be open outward and upward, so that these inclined surfaces receive the front and rear wheels of car to hold the car on the conveyor.

Further, the width of conveyor on the loading/unloading berth is determined so as to be smaller than the distance between the wheels of car, and a pair of vertically movable floors are installed at both sides of the conveyor at an interval nearly equal to the wheel base of car, by which a car is mounted on the movable floors and then the bottom of car is mounted on the conveyor by lowering the movable floors. Thus, a car can be transferred in a stable condition.

Also, a part of the ramp for drive-on and drive-off is formed by an upper ramp which opens/closes the car loading port at the ship side and is kept horizontal when being turned down. On the upper ramp, a turntable for changing the direction of car can be installed. Thus, during unloading, a car driven backward to the upper ramp is turned on the turntable and driven forward onto the quay.

DETAILED DESCRIPTION OF PREFERRED EMBODIMENTS

Figure 1:
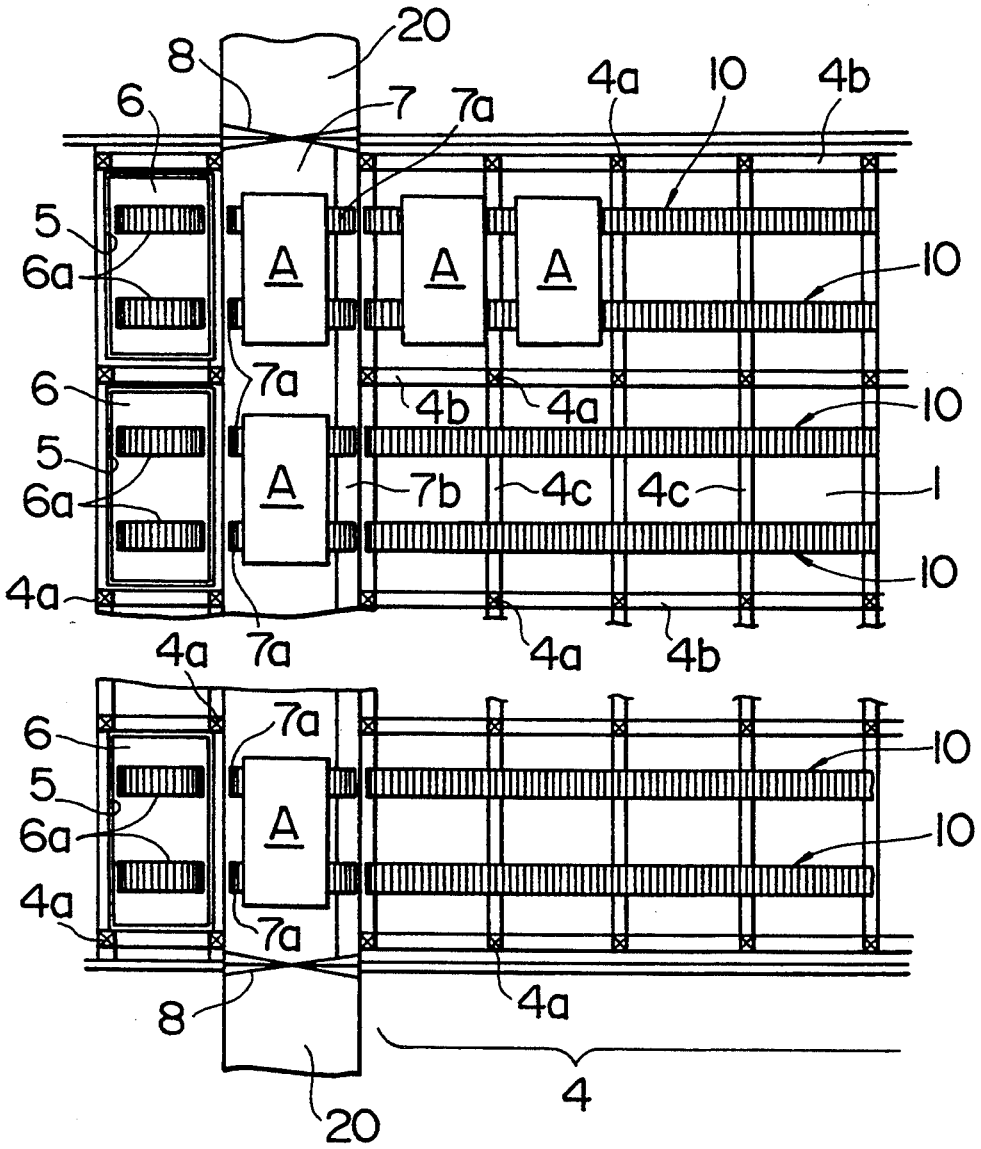
FIG. 1 is a plan view showing a first embodiment of the car storage apparatus in a car carrier in accordance with the present invention.
Figure 2:
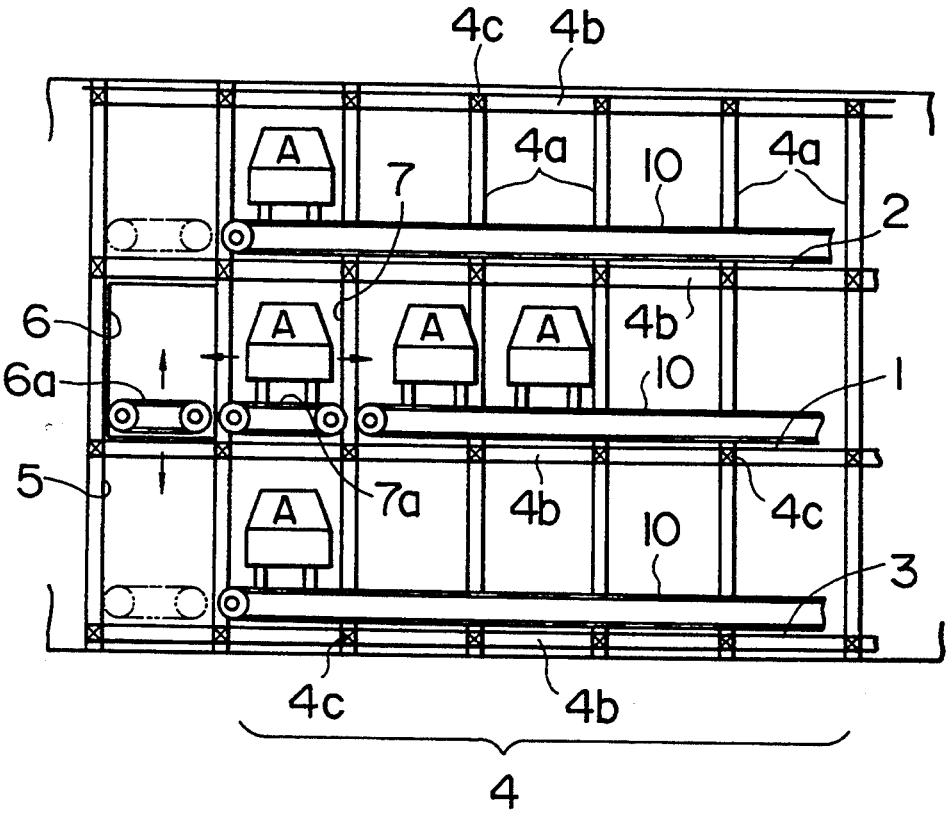
FIG. 2 is a side view of the embodiment shown in FIG. 1.

A first embodiment of the car storage apparatus in a car carrier in accordance with the present invention is illustrated in FIGS. 1 through 4. In these figures, a car storage compartment 4 consisting of three car storage decks 1, 2, 3 is formed in the car carrier. At the left end of car storage decks 1, 2, 3, elevator shafts 5 extend vertically through these decks. In the elevator shaft 5, a lifter 6 is disposed to move a car vertically. On the car storage deck 1, a car loading/unloading berth 7 is installed as described later. Sometimes this car storage deck 1 is particularly called a deck for both loading/unloading and storage.

Conveyors 10 are installed on each car storage deck 1-3, and a conveyor 6*a* is also installed on the floor surface of each lifter 6. Thus, a car A is transferred by the conveyors 10, 6*a*. At the starboard and port side of the car storage deck 1, a loading port 8, 8 is formed, to which a shore ramp 20, 20 is connected. The loading-/unloading berth 7, which is disposed between the loading ports 8, 8, has conveyors 7*a*. The conveyor 7*a* transfers a car A driven onto the loading/unloading berth 7 onto the conveyor 6*a* of the lifter 6 (transfer to the left in FIGS. 1 and 2), or onto the conveyor 10 on the car storage deck 1 (transfer to the right in FIGS. 1 and 2).

Figure 3:
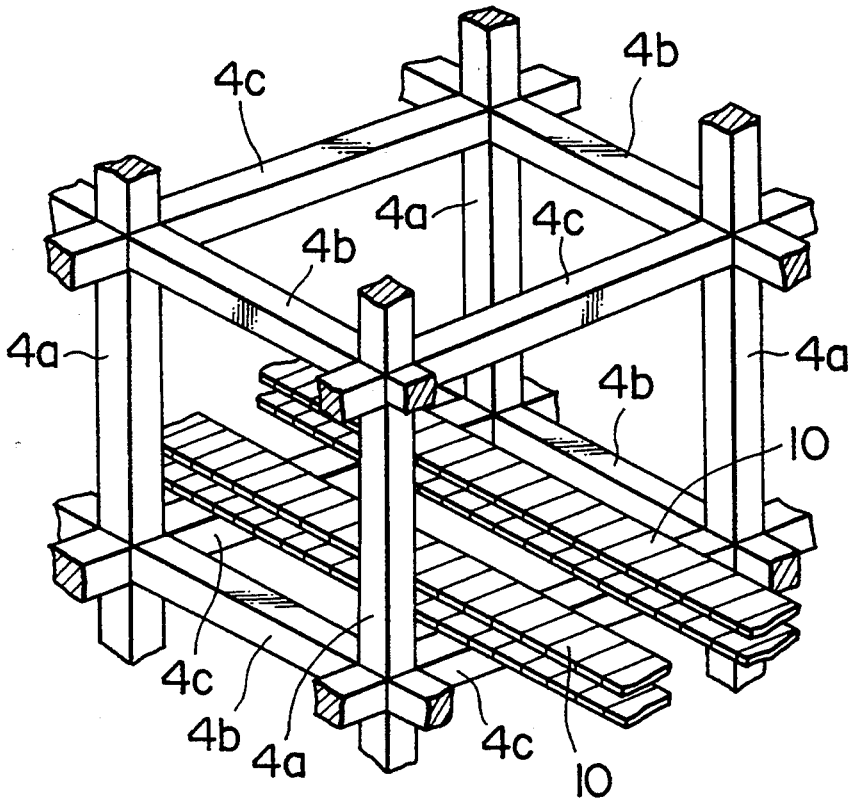
FIG. 3 is a perspective view of the main part.

If the car storage compartment 4 is composed of a framework consisting of pillars 4*a*, longitudinal girders 4*b*, and transverse girders 4*c* as shown in FIG. 3, the need for installing decks in the car storage compartment is eliminated. The longitudinal girders 4*b*, transverse girders 4*c*, and pillars 4*a* not only support the conveyor 10 but also serve as strength members of the ship hull.

According to the above construction, when a car A is loaded, a car A is driven by a driver to the loading/unloading berth 7 on the deck for both loading/unloading and storage 1 through the loading port 8 by going through the shore ramp 20. The driver gets out of the car at the loading/unloading berth 7, and goes out of the ship through a pedestrian passage 7*b*. Once it is confirmed that the driver has gotten out of the car, the coneyor 7*a* installed on the floor of the loading/unloading berth 7 is operated to transfer the car to the lifter 6. After the car is carried on the lifter 6, the lifter 6 is moved up or down to a predetermined car storage deck 2 or 3 and is stopped there. After stopping, the car is transferred to the car storage compartment 4 via the conveyor 6*a* and the conveyor 10. When the car is transferred to the car storage compartment 4, the lifter 6 is returned to the deck for both loading/unloading and storage 1 for the next storage operation.

A car is unloaded by reversing the loading procedure. To unload a car, the car stored in the car storage compartment 4 is transferred onto the lifter 6 via the conveyor 10, and then the lifter 6 is moved up or down to the deck for both loading/unloading and storage 1. After the lifter 6 is stopped at the deck for both loading-/unloading and storage 1, the car A is transferred to the loading/unloading berth 7 by the conveyors 6*a*, 7*a*, where a driver gets on the car to drive it out of the ship through the loading port 8 by going through the shore ramp 20.

When a car is stored on the car storage deck 1, the car is transferred directly from the loading/unloading berth 7 to the conveyor 10 on the car storage deck 1.

On the car storage deck 1–3, the conveyor 10 moves a distance corresponding to the width of one car (exactly, the car width plus some distance) when a car is stored, and the car is stored while it is mounted on the conveyor 10. That is to say, the conveyor 10 not only serves for transferring a car but also provides a car storage location. A car in storage is fixed by the conventional fixing means.

Figure 4:
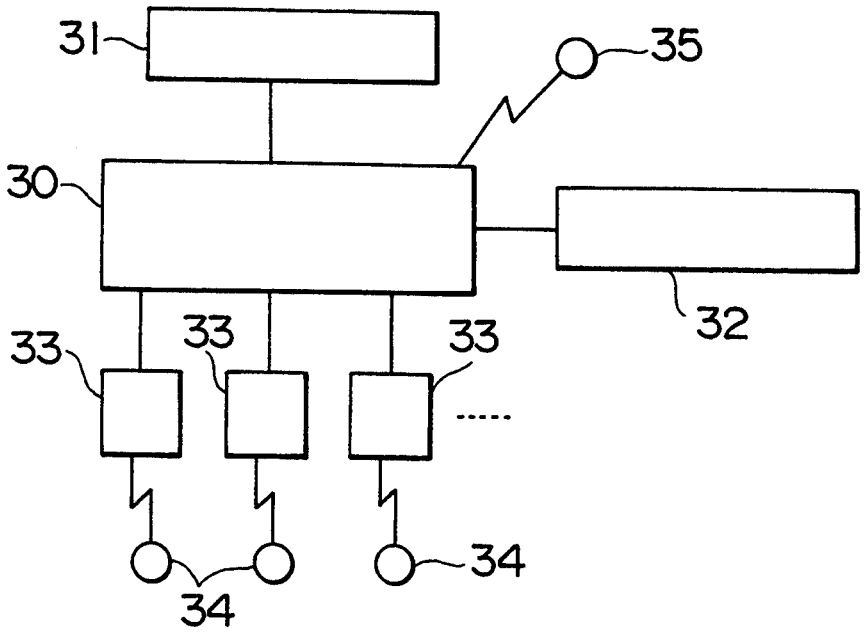
FIG. 4 is a schematic diagram of automation system for the device.

An example in which the above-described storing and unloading operations are automated will be described below. FIG. 4 is a schematic diagram of automatic storage system having a host computer 30 for controlling the storage condition of cars. The host computer 30 is connected to computers 33, 33, . . . which detect the storage condition on each car storage deck 1–3 by receiving a signal from a sensor 34 which is installed on each car storage deck 1–3 and detects the storage condition. The host computer 30 is also connected to a sensor 35 installed on each lifter 6 to send a signal telling that a car has been placed on the lifter 6. A control device 32 for controlling conveyors 6*a*, 10, 7*a* operated by a signal from the host computer 30 and a control device 31 for the lifter 6 are connected to the host computer 30.

When a car A is driven onto the loading/unloading berth 7 and the driver gets out of the car and presses the START button, the conveyor 7*a* on the floor of the loading/unloading berth 7 is operated, and the car is transferred onto the lifter 6. The sensor 35 of the lifter 6 sends a signal to the host computer 30, telling that the car A has been placed on the lifter 6. The host computer 30 has a storage schedule inputted in advance to show how many cars can be stored on each deck. In accordance with this storage schedule, a signal is sent to the lifter control device 31; as a result, the lifter 6 is moved to the appropriate car storage deck. When the lifter arrives at the appropriate car storage deck, the sensor 34 installed on each deck is operated, and sends a signal to the conveyor control device 32 telling that the car A has arrived at the deck. After receiving the signal, the conveyor control device 32 is operated. Thus, the conveyor 6*a* on the floor of the lifter and the conveyor 10 on the appropriate car storage deck are operated to transfer the car A onto the appropriate car storage deck.

The sensor 34, which is installed at the entrance of each car storage deck, sends a signal to the computer 33 on each car storage deck when the storage of car A is detected. The computer 33 recognizes the storage condition on that car storage deck, and this information is sent to the host computer 30.

The addition of an automatic storage system as shown in FIG. 4 enables automatic storage and unloading of cars.

The embodiment of car storage apparatus in the car carrier described above offers the following effects:

(1) The number of skillful drivers for storing cars can be decreased and the time taken for storage can be shortened, leading to the increase in cargo handling efficiency.

(2) The need for drivers to go to the storage location is eliminated, which improves safety of drivers.

(3) The number of cars on each car storage deck can be easily and accurately controlled because of the use of computer.

(4) The use of framework as shown in FIG. 3 for the car storage compartment eliminates the need for installation of decks for the car storage compartment, which reduces the ship hull weight and improves the ship performance. (5) The work enviroment in the ship is improved because cars are not driven in the ship.

Figure 5:
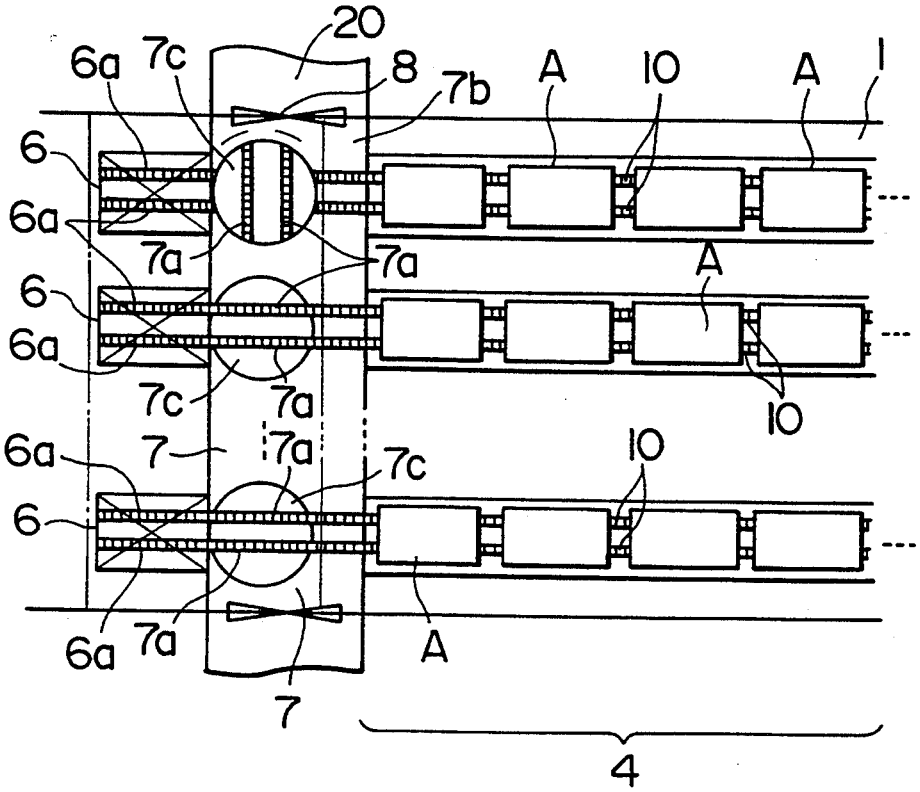
FIG. 5 is a plan view showing a second embodiment of the car storage apparatus in a car carrier in accordance with the present invention.
Figure 6:
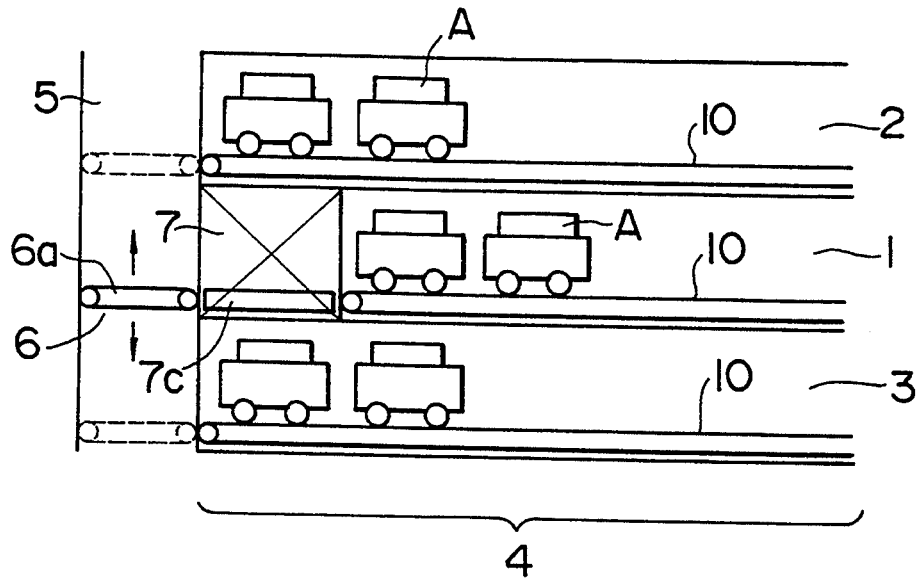
FIG. 6 is a side view of the embodiment shown in FIG. 5.

Next, a second embodiment of car storage apparatus will be described with reference to FIGS. 5 and 6.

This embodiment of car storage apparatus differs from the first embodiment in that turntables *7c* are installed on the loading/unloading berth 7. In this embodiment, therefore, a car A is loaded by being driven onto the turntable *7c* through the loading port 8 by going through the shore ramp 20. On the turntable *7c*, the driver gets out of the car A and goes out of the ship through the pedestrian passage *7b*. Once it is confirmed that the driver has got out of the car, the turntable *7c* is turned 90 degrees, so that a conveyor *7a* installed on the floor of the turntable *7c*, the conveyor 10 in the car storage compartment 4, and the conveyor *6a* on the lifter 6 are in line with each other. Therefore, the car is transferred to the lifter 6 by the conveyor *7a*. When the car is carried on the lifter 6, the lifter 6 is moved up or down to a predetermined car storage deck 2 or 3 and is stopped there. After stopping, the car is transferred to the car storage compartment 4 via the conveyor *6a* on the floor of lifter 6 and the conveyor 10 on the car storage deck. Unlike the first embodiment, the car is stored so that the direction of car is the same as that of the conveyor movement. When the car is transferred to the car storage compartment 4, the lifter 6 is returned to the deck for both loading/unloading and storage 1 for the next storage operation.

A car is unloaded by reversing the loading procedure. To unload a car, the car stored in the car storage compartment 4 is transferred onto the lifter 6 via the conveyor 10. After the car A is carried on the lifter 6, the lifter 6 is moved up or down to the deck for both loading/unloading and storage 1 and stopped there. After the lifter 6 is stopped at the deck for both loading-/unloading and storage 1, the car A is transferred to the turntable *7c* by the conveyor *6a*, After the car is placed on the turntable *7c*, the turntable *7c* is turned 90 degrees so that the car A faces the loading port 8. At this time, a driver gets on the car to drive it out of the ship through the loading port 8 by going through the shore ramp 20. Needless to say, also in this embodiment, the storing operation can be fully automated by using computers to carry out the above-described operations.

Figure 7:
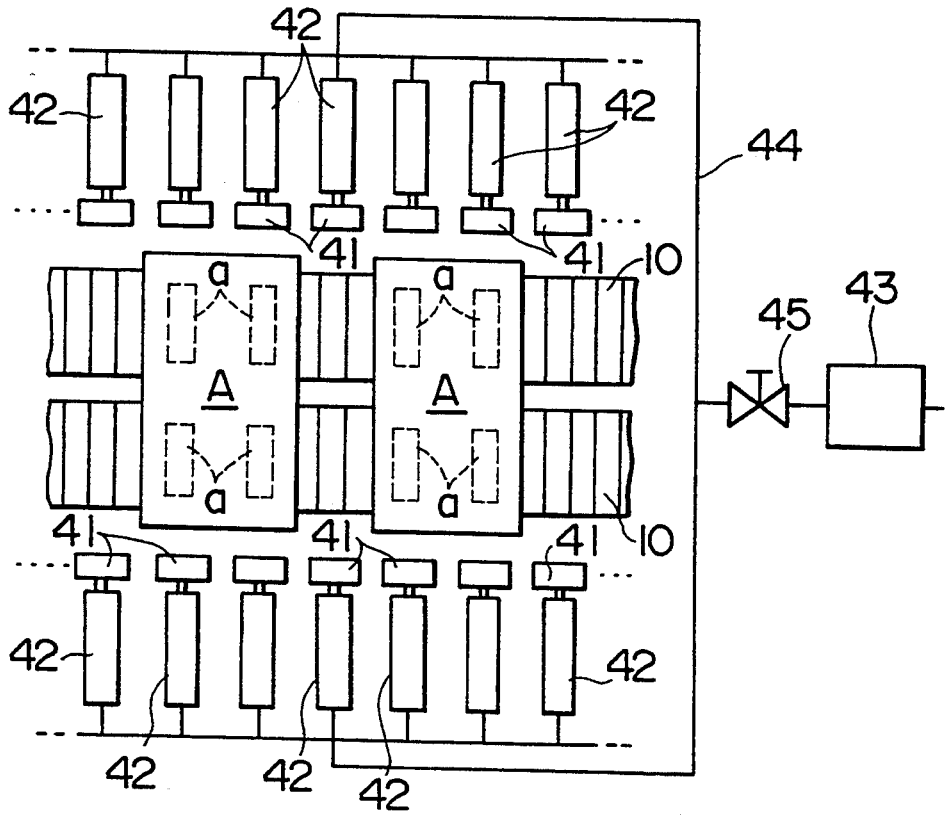
FIG. 7 is a schematic plan view showing automatic car fixing device for the car storage apparatus of the present invention.
Figure 8:
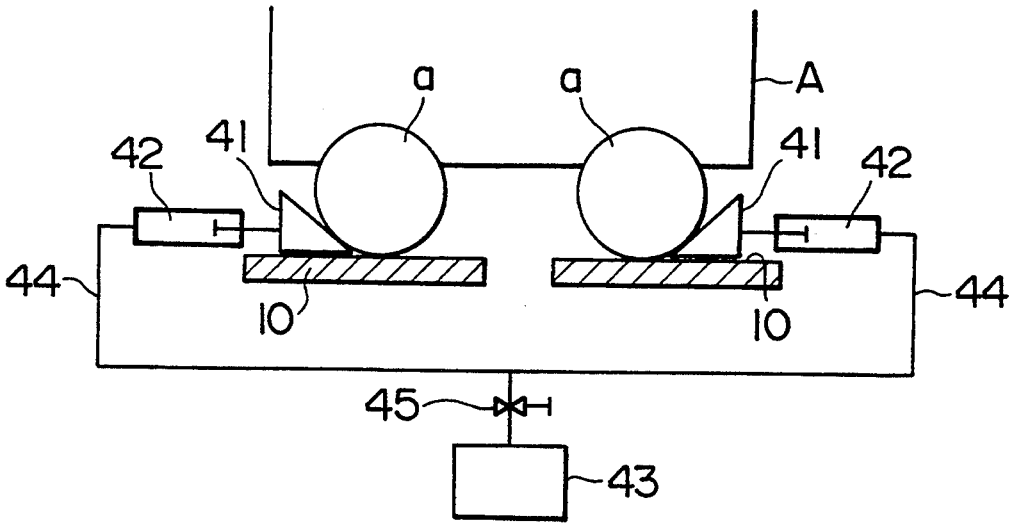
FIG. 8 is a side view showing the fixing condition of the device.
Figure 9:
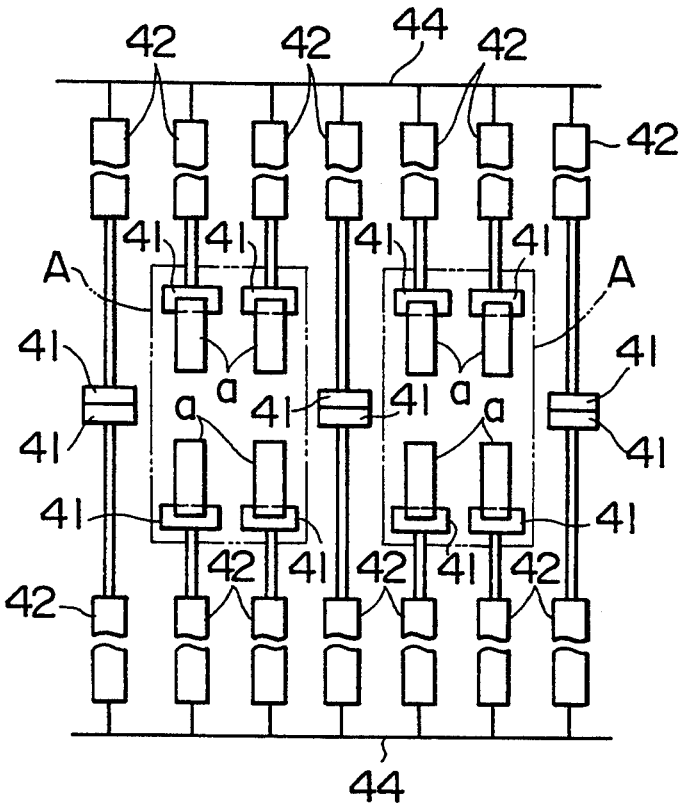
FIG. 9 is a plan view showing the fixing condition of the device.
Figure 10:
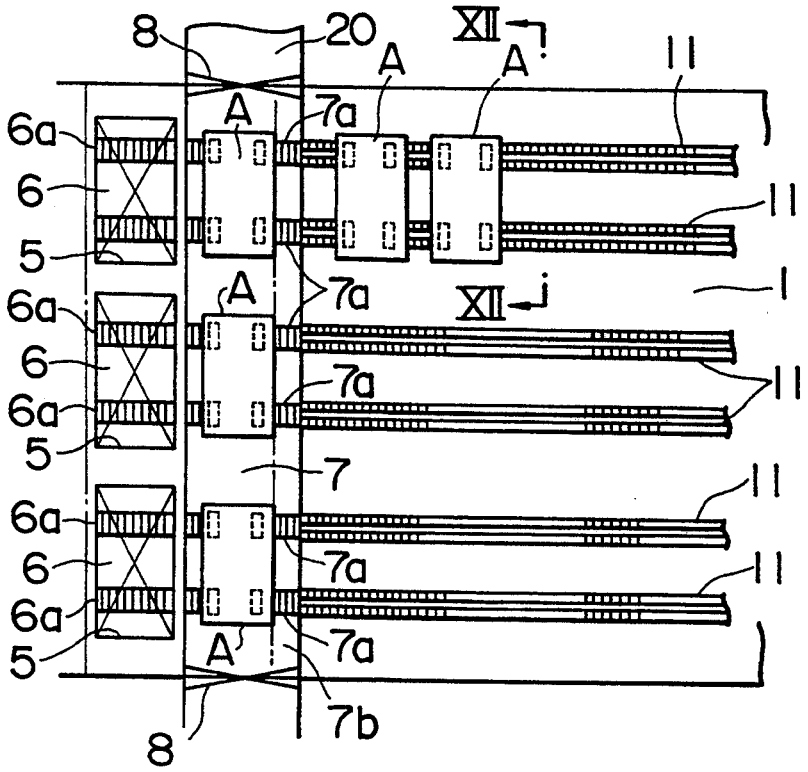
FIG. 10 is a plan view showing a third embodiment of car storage apparatus in accordance with the present invention.
Figure 11:
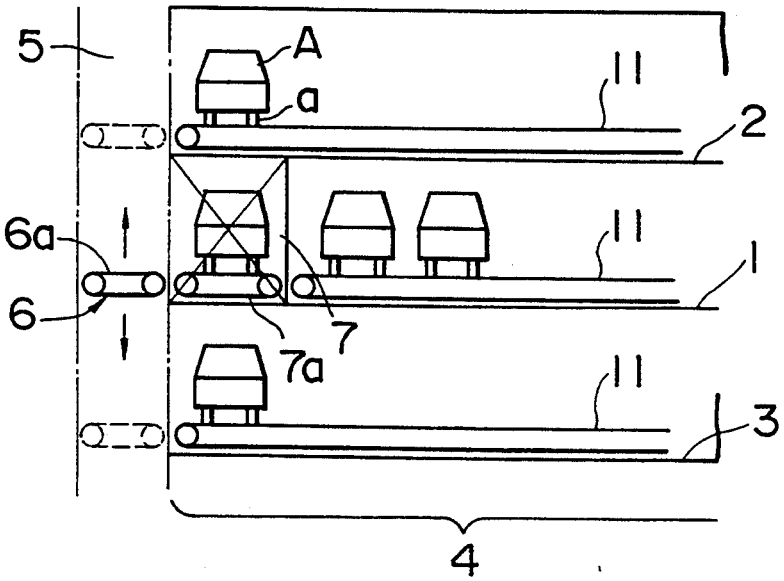
FIG. 11 is a side view of the embodiment shown in FIG. 10.

This embodiment offers additional effect in addition to the effects offered by the first embodiment:

FIGS. 7 through 9 show an automatic car fixing device for the car storage apparatus of the present invention. With this automatic car fixing device, a pair of conveyors 10, 10 are installed in the storage space on the car storage deck of car carrier.

The conveyors 10, 10 can carry a car A and transfer it to a predetermined storage position. The car A is conveyed to the predetermined storage position with the front and rear wheels being mounted on the conveyors 10, 10 and then it is fixed as it is (being mounted on the conveyors 10, 10). The car carrier carriers cars in this condition to the destination. Reference numerals 41, 41 denote wheel stops which engage with the front and rear wheels a, a of the car A from the outside to prevent rolling and slipping of front and rear wheels a, a. Each wheel stop 41 is connected to an independent hydraulic cylinder 42. The wheel stop 41 is disposed in such a manner that it is opposed to the wheel a, a, . . . of the car A placed at the predetermined storage position. The hydraulic cylinder 42 is adapted to be operated by one (common) hydraulic regulator 43. The hydraulic cylinders 42 are connected to the hydraulic regulator 43 by a hydraulic pipe 44 via a valve 45.

In the above-described arrangement, when the car A stops at the predetermined storage position (at this time, the conveyor 10, 10 stops with the car A being mounted thereon), the wheel stops 41 installed in front and rear of the car A move toward the car A. The wheel stop 41 moves to the position of wheel a, is pushed against the wheel a, and stops. If either of front or rear wheel stops 41 stops, the other wheel stops 41 continues to move, and finally the movement of wheel stops is completed at the time when wheel stops on both sides are pushed against the wheels a. When the wheel stops 41 are pushed against the wheels a by a proper force, the valve 45 installed between the hydraulic cylinder 42 and the hydraulic regulator 43 is closed to fix the wheels a. The force for fixing the wheels a is adjusted by the oil pressure of hydraulic cylinder 42 connected to the wheel stop 41. The hydraulic regulator 43 is provided with an oil pressure indicator (not shown) for indicating the oil pressure in the hydraulic cylinder 42. The construction may be such that a worker closes the valve 45 when he/she verifies the oil pressure value necessary to fix the wheels a by observing the oil pressure indicator, or such that the valve 45 closes automatically when the fixing condition of wheels is detected mechanically, as a full automated system.

As shown in FIG. 9, the wheel stops 41 which do not touch the wheels a move to the middle part of the storage space and stop at the time when they come into contact with each other. The above-described fixing operation is carried out at the same time for many cars, and the wheel stop 41 is so constructed that it flexibly accommodates various wheel sizes.

This automatic car fixing device described above in detail offers the following effects:

(1) The automatic fixing operation provides labor saving and shortens the operation time.

(2) The car fixing device fixes cars with a proper force and accommodates cars with different wheel base because the wheel stops can be moved and pushed against the wheels by hydraulic control.

(3) Several cars can be fixed at the same time, resulting in higher operation efficiency.

FIGS. 10 through 14 show a third embodiment of automatic storage apparatus in accordance with the present invention. In this embodiment, a car storage compartment 4 consisting of three car storage decks 1, 2, 3 is formed in a car carrier. At the left end of car storage decks 1, 2, 3, elevator shafts 5 extend vertically through these decks. In the elevator shaft 5, a lifter 6 is disposed so as to move a car vertically. On the car storage deck 1, which is middle one of three decks 1, 2, 3, a shore ramp way 20 for loading cars A, a loading port 8, a loading/unloading berth 7, and a pedestrian passage **7*b*** for drivers are installed.

Figure 12:
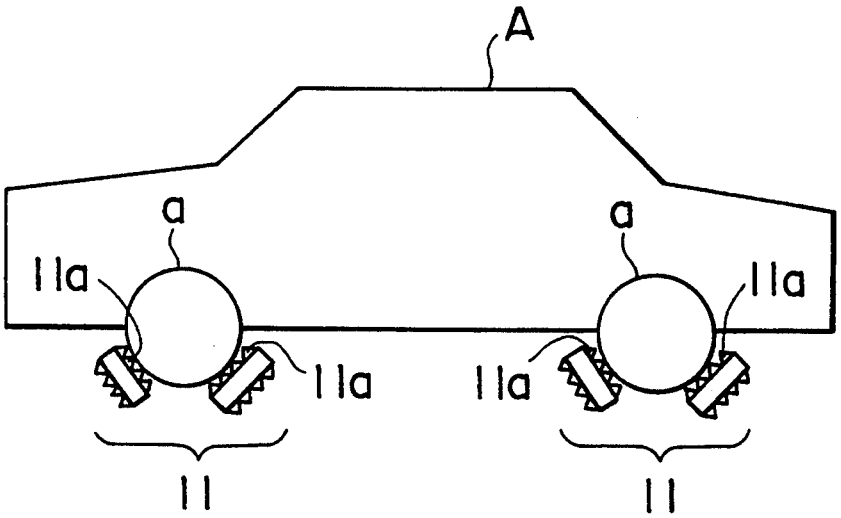
FIG. 12 is a sectional view taken along the plane of line XII—XII of FIG. 10.
Figure 13:
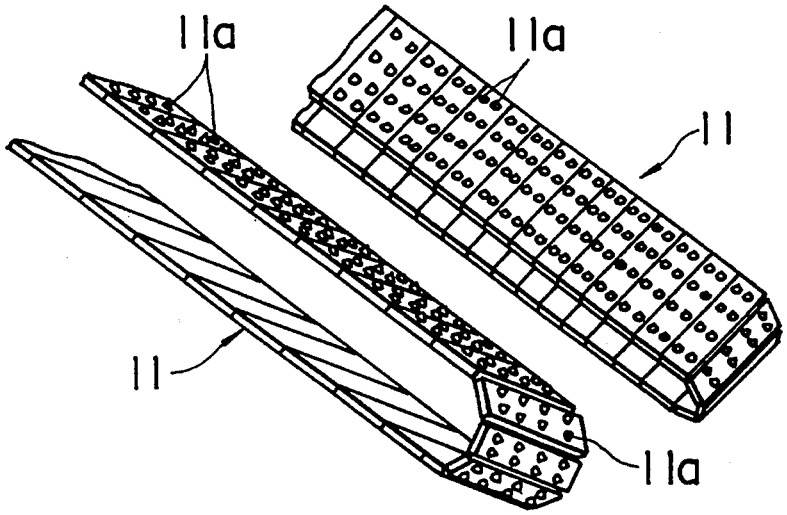
FIG. 13 is an partially expanded perspective view of a conveyor.

On each car storage deck 1, 2, 3, two sets of conveyors 11, 11 are installed in parallel with their upper surfaces being open upward to fix the front and rear wheels of the stored car as shown in FIGS. 12 and 13. The inclined surfaces of a pair of conveyors 11, 11 have projections **11*a*** for preventing the wheel from slipping.

On the lifter 6 and the loading/unloading berth 7, conveyors **6*a*, 7*a* for transferring and fixing a car are installed. Each of these conveyors 6*a*, 7*a* is a conveyor because it is not only for fixing a car but also for transferring a car. According to the above construction, when a car A is loaded, a car A is driven by a driver to the loading/unloading berth 7 through the loading port 8 by going through the shore ramp way 20. The driver gets out of the car at the loading/unloading berth 7, and goes out of the ship through a pedestrian passage 7*b* on the loading/unloading berth. Cars A are loaded sequentially by the same procedure. A car carried to the loading/unloading berth 7 is transferred to two sets of two-row conveyors 11, 11 installed on the car storage deck 1 in the car storage compartment 4 by the conveyor 7*a*. When the front and rear wheels a of the car A is mounted on a pair of conveyors 11, 11 having inclined surfaces, the car A is fixed by the compressive force applied to the inclined surfaces by the weight of the car A and frictional resistance of projections 11*a*** formed on the inclined surfaces at the same time when the car A is stored.

A car A is stored on the storage lane on the car storage deck 2, 3 above or below the car storage deck 1 as follows: A car carried to the loading/unloading berth 7 is transferred to the lifter 6 by the conveyor **7*a*, and then the car is moved up or down to the car storage deck 2 or 3. After that, the car is stored and fixed by the same procedure as that on the car storage deck 1**.

Figure 14:
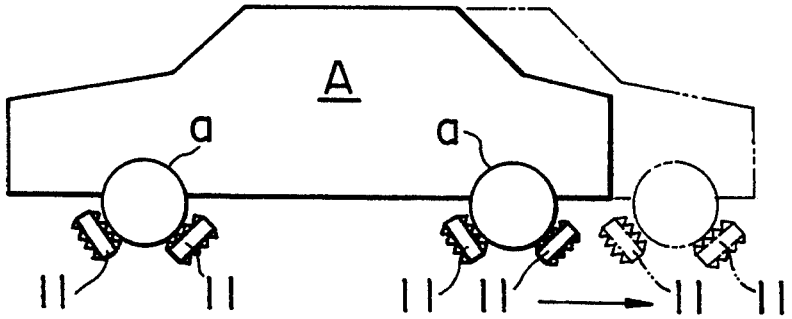
FIG. 14 is a side view showing the storage condition of cars with different wheel base.
Figure 15:
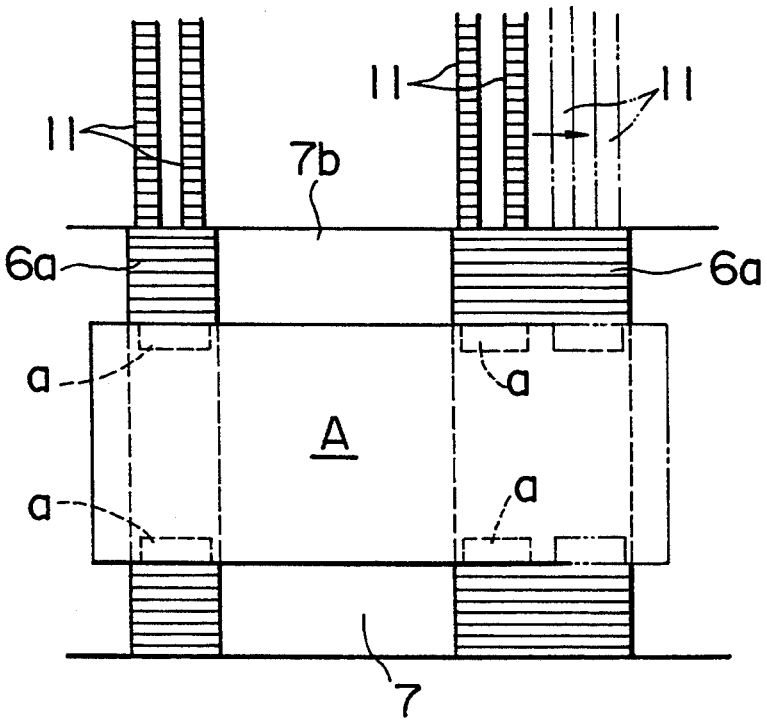
FIG. 15 is a plan view showing the storage device shown in FIG. 14.

A pair of two-row conveyors 11, 11 having inclined surfaces for the rear wheels are designed to be movable to some distance in the car length direction. Thus, this device can be used for cars with different wheel base as shown in FIG. 14.

This embodiment offers the following effects:

(1) Manual storage operation by skilled workers is reduced, and the operation time is shortened because a car is fixed at the same time when it is stored, significantly increasing the cargo handling efficiency.

(2) Safety in operation is improved because the drivers do not go to the storage location and the need for car fixing work is eliminated.

(3) The work environment in the ship is improved because cars are not driven in the ship.

According to this embodiment, the car storage apparatus comprises a loading/unloading berth which is installed on the car loading deck and has a pedestrian passage at one side; a plurality of storage lanes having a belt conveyor for the front wheel and a belt conveyor for the rear wheel installed in parallel at an interval equal to the wheel base of stored car, the conveyor having a V-shaped cross section; car lifters which moves up or down in a plurality of elevator shafts installed at equal intervals on the other side of the loading/unloading berth and extending vertically through the car storage decks at; and belt conveyors for front wheel and belt conveyors for rear wheel which are installed in pairs on the loading/unloading berth and lifters Therefore, this embodiment provides an economical car storage apparatus for car carrier, in which many cars can be transferred to multi-stage storage lanes and fixed safely and rapidly and with minimum manpower without driving cars in the ship. Thus, this embodiment is very useful in the industry.

Figure 16:
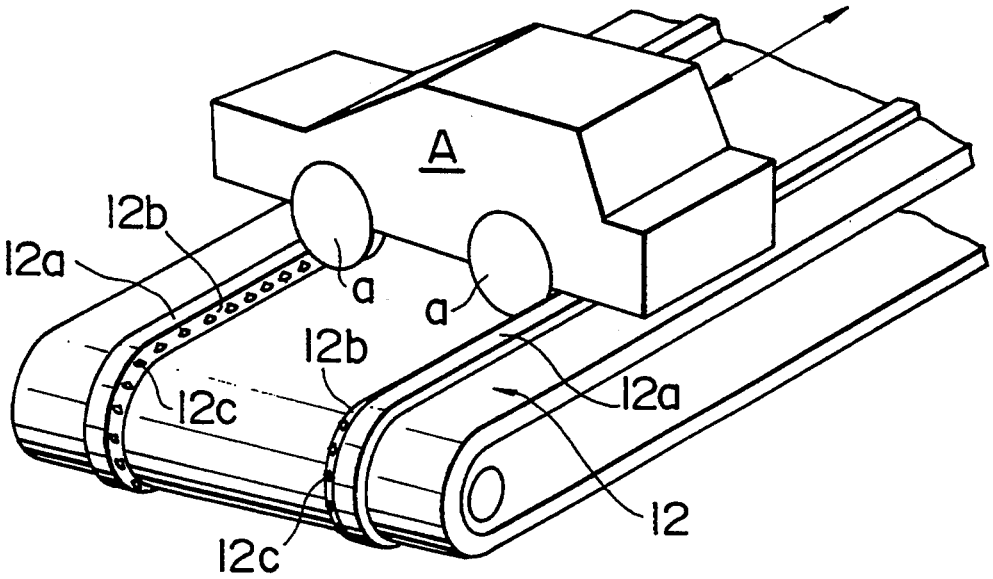
FIG. 16 is a partial perspective view of a belt conveyor used in a fourth embodiment of the present invention.
Figure 17:
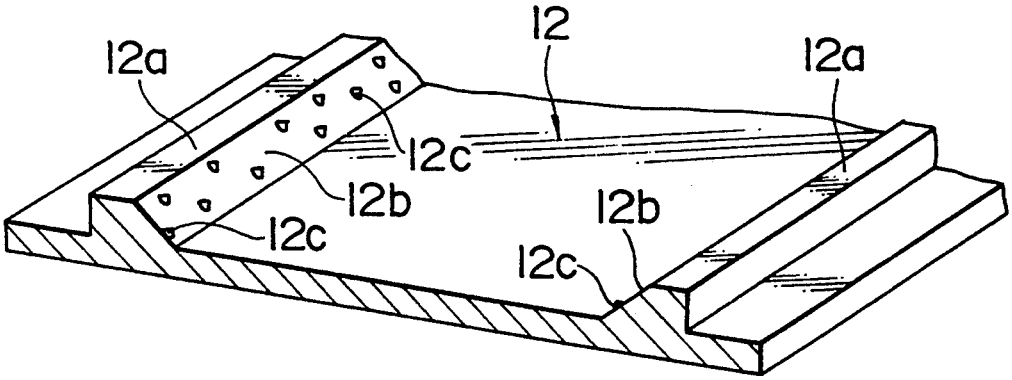
FIG. 17 is a transverse sectional view of the belt conveyor shown in FIG. 16.
Figure 18:
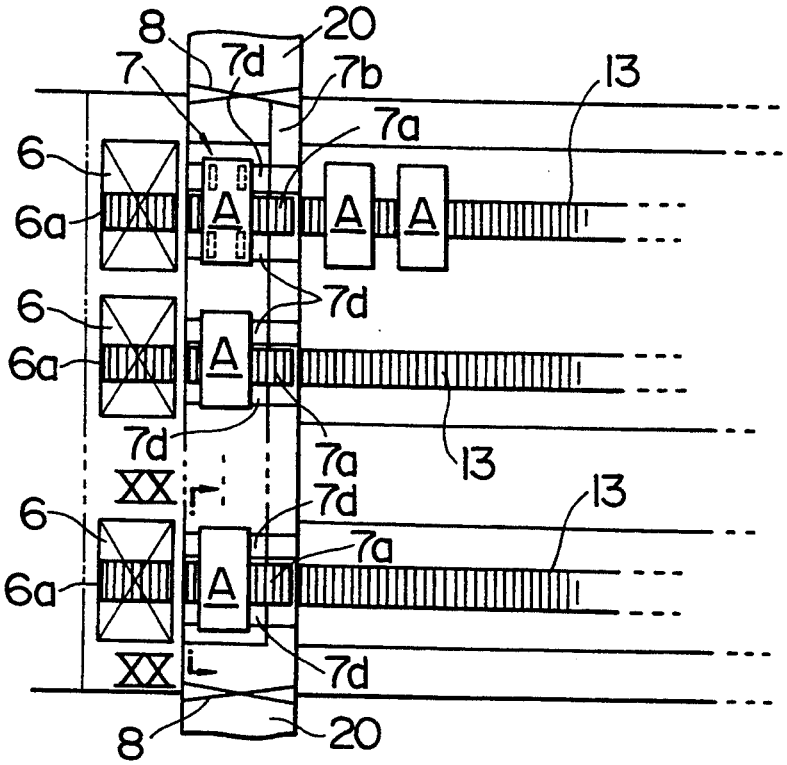
FIG. 18 is a plan view showing a fifth embodiment of the car storage apparatus in accordance with the present invention.

FIGS. 16 and 17 show a fourth embodiment of the car storage apparatus, particularly showing a conveyor installed on the car storage deck.

In these figures, reference numeral 12 denotes an conveyor, which has a ridge **12*a* at a position near each edge of conveyor. The ridge protrudes from the upper surface of conveyor and has a trapezoidal shape. These ridges 12*a*, 12*a* have an inclined opposing surface 12*b*, and these inclined surfaces 12*b*, 12*b* cooperate with each other to hold a car A on the conveyor 12 by abutting against the front of the front wheel a and the rear of the rear wheel a. The inclined surfaces 12*b*, 12*b* have many projections 12*c*** for increasing frictional force against a tire a.

In this construction, a car A is mounted on the conveyor 12, and each time when the car is mounted, the conveyor 12 is intermittently moved a distance substantially equivalent to the width of one car. Then, the next car is mounted on the conveyor 12. By repeating this procedure, cars are loaded in the storage compartment. When the stored cars are unloaded, the conveyor 12 is moved intermittently in the reverse direction.

A car carrier having such an apparatus offers the following effects:

(1) The operation in which a worker carries wheel stops for preventing a car from moving and to sets them at the tire portion and the operation for storing and controlling wheel stops become unnecessary.

(2) The conveyor not only provides a car storage location but also transfers a car to and from the storage position, which reduces the number of workers and saves the labor in loading and unloading cars.

(3) A third ridge can be installed in parallel at the middle part in addition to the two side ridges to accommodate a different wheel base of car.

According to this embodiment, in a car carrier which is adapted to mount and store a plurality of cars in parallel on the conveyor installed in the ship, ridges of a trapezoidal shape which protrude from the upper surface of conveyor at a position near each edge of conveyor in parallel at the substantially same interval as the wheel base. These ridges have an inclined opposing surface **12*b*** which is open upward, and these inclined surfaces cooperate with each other to hold a car on the conveyor by abutting against the front of the front wheel and the rear of the rear wheel. The use of conveyor having a wheel stop function provides a car carrier in which the number of workers is reduced and the labor is saved because the conveyor not only transfers a car to and from the storage compartment but also serves as a wheel stop. Thus, this embodiment is very useful in the industry.

FIGS. 18 through 21 show a fifth embodiment of the car storage apparatus.

In this embodiment, the longitudinal car storage compartment 4 is formed by a plurality of car storage decks 1, 2, 3. At one end of car storage decks 1, 2, 3, elevator shafts 5 extend vertically through these decks. In the elevator shaft 5, a lifter 6 is disposed so as to move a car vertically. At the starboard and port side of the car storage deck 1, a loading port 8, 8 is formed, to which a shore ramp way 20, 20 are installed toward the outside of ship. Between the loading ports, the loading/unloading berth 7 and the pedestrian passage 7*b* for drivers are disposed. On the lifters 6 and the loading/unloading berth 7, conveyors 6*a*, 7*a* for transferring a car, which are operatively associated with each other, are installed, respectively.

Figure 20:
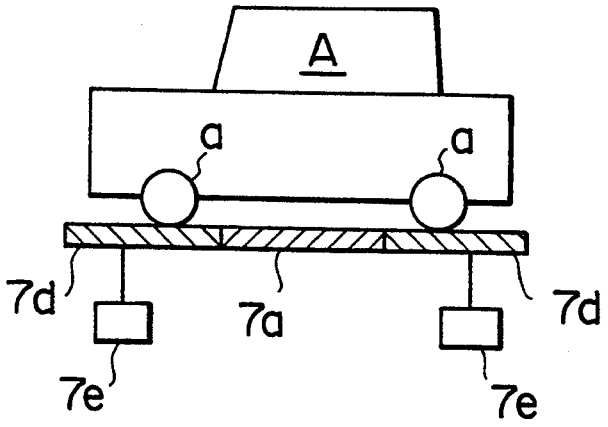
FIG. 20 is a sectional view taken along the plane of line XX—XX of FIG. 18, in which a car is not in contact with a conveyor.

According to the above construction, when a car A is loaded, a car A is driven by a driver into the ship through the loading port 8 by going over the shore ramp 20, and is stopped at a predetermined position on the loading/unloading berth 7. At this time, movable floors 7*d* on the loading/unloading berth 7 are in the raised position as shown in FIG. 20, and the tires a of car A abut against the movable floors 7*a*, so that the driver gets out of the car A and goes out of the ship through the pedestrian passage 7*b*.

Figure 19:
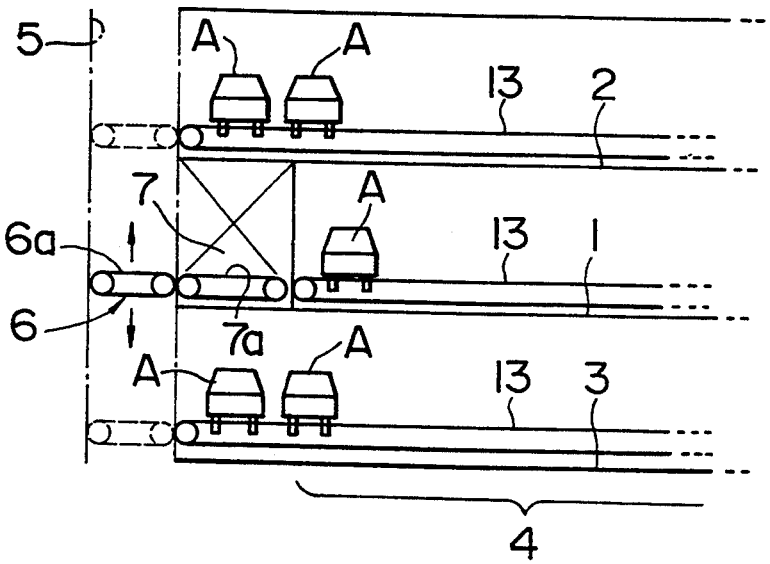
FIG. 19 is a side view of the embodiment shown in FIG. 18.
Figure 21:
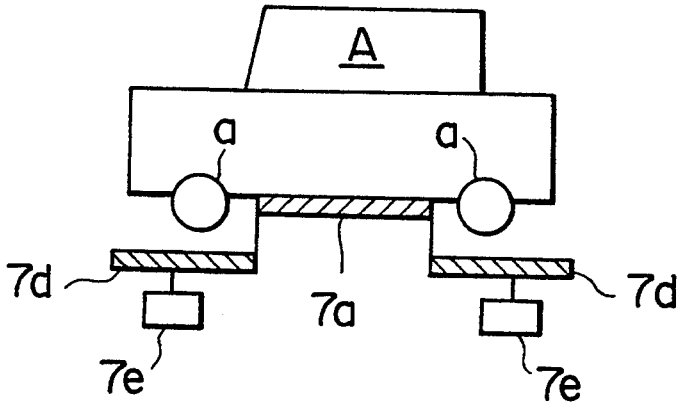
FIG. 21 is a sectional view of the same place as that of FIG. 20, in which wheels of a car are not in contact with a conveyor.
Figure 22:
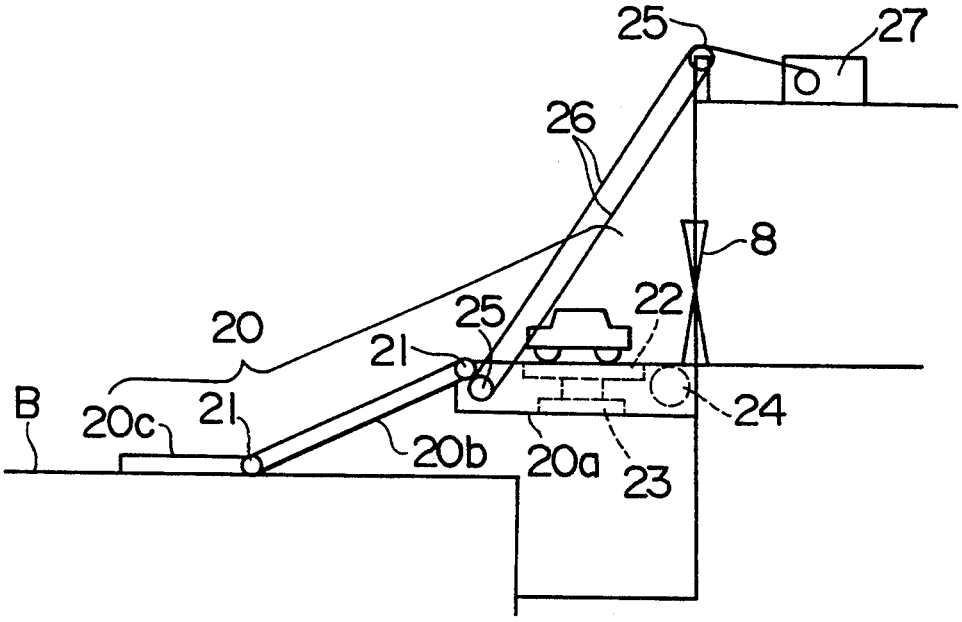
FIG. 22 is a sectional view of a shore ramp for the car storage apparatus in accordance with the present invention.
Figure 23:
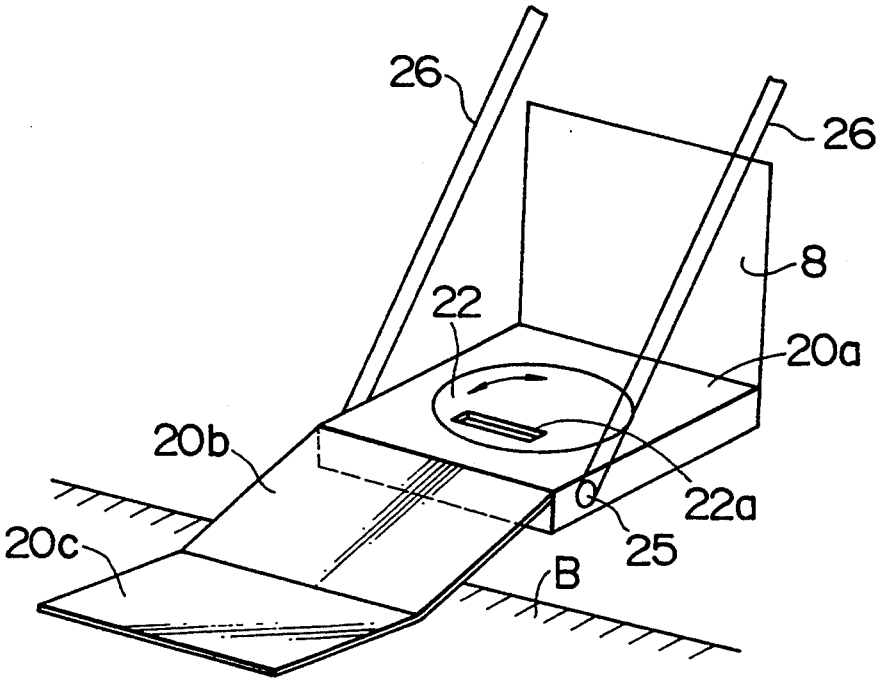
FIG. 23 is a perspective view of the shore ramp shown in FIG. 22.

The movable floors 7*d* are lowered to the lowered position by a hydraulic system 7*e* as shown in FIG. 21. Then, the car A is transferred longitudinally by a conveyor 7*a* with the car bottom being supported by the conveyor 7*a*, and is mounted on a storage conveyor 13 with the car bottom being supported by the conveyor 13 and the tires a being not supported. By the movement of storage conveyor 13 in the longitudinal direction, the car A enters the car storage compartment 4. Alternatively, a car A enters the lifter 6 as necessary as shown in FIG. 19. The car A on the lifter is moved to the upper-stage deck 2 or the lower-stage deck 3 by the vertical movement of the lifter 6, and enters the car storage compartment 4 on the upper-stage deck 2 or the lower-stage deck 3 by the cooperative action of the conveyor 6*a* on the lifter 6 and the storage conveyor 13 in the storage compartment 4. In either case, the movable floors 7*d* of the loading/unloading berth 7 are returned to the same level as that of the storage conveyor 13 (FIG. 20). When the lifter 6 returns to the loading deck level, the next car A can be driven onto the loading/unloading berth 7. Thus, cars A are transferred to a farmost position in the car storage compartment 4 for storage.

After all cars A are stored, each car A is mounted on the storage conveyor 13 with the car bottom being supported by the storage conveyor 13 and the tires a being kept from the deck 1, 2, 3. Since the contact area between the storage conveyor 13 and the car bottom is large, the car can be fixed by simple conventional means.

To unload cars, operation is performed by reversing above procedure. A car A is transferred to the loading-/unloading berth 7 by the storage conveyer 13 in the car storage compartment 4 and the lifter 6 with the movable floors being lowered (FIG. 21). Then, the movable floors 7*d* are raised (FIG. 20), and a driver, coming through the pedestrian passage 7*b*, gets on the car A and drives it onto the quay through the loading port 8.

This construction offers the following effects:

(1) Drivers need not have high skill and the required number of drivers is few because a driver drives a car only to the loading/unloading berth. Drivers walking in the ship does not encounter running cars.

(2) The loading time can be shortened because the next car can be driven onto the loading/unloading berth when the preceding car is moved from the loading/unloading berth and the floors of the berth are raised.

(3) Exhaust gas does not accumulate in the ship because cars are moved in the ship by the horizontal transfer device and the lifting device.

(4) Only simple fixing operation is required because the car bottom is in contact with the conveyor in a large contact area and the tires are free in the air.

According to this embodiment, the car storage apparatus comprises a shore ramp way which is installed on the car loading deck in the ship width direction and has a pedestrian passage at one side; a plurality of rectangular loading/unloading berths which are installed at equal intervals on the shore ramp way and each of which has a transfer conveyor for longitudinally transferring cars at its center; a plurality of longitudinal storage conveyors which extend in parallel at equal intervals on one side of the shore ramp way and have a width somewhat smaller than the distance between the front and rear wheels; lifters for moving a car up and down in a plurality of elevator shafts which are installed at equal intervals on the other side of the ramp way, extend vertically through the car storage decks, the lifter having a conveyor for longitudinally transferring a car; and a pair of movable floors which are installed in parallel at both sides of the loading position of the longitudinal storage conveyor and are raised/lowered by a height nearly equal to the radius of car wheel. With this construction, a car on the loading/unloading berth is transferred and stored directly on the car storage conveyor by the raising/lowering of the movable floors, or is transferred and stored indirectly on the car storage conveyor on the upper- or lower-stage deck by the raising/lowering of the movable floors and the raising/-lowering of the lifter. Therefore, this embodiment provides an economical car storage apparatus for car carrier in which many cars can be stored on the car storage decks rapidly and surely and with minimum manpower. Thus, this embodiment is very useful in the industry.

FIGS. 22 through 25 shows a shore ramp in the car storage apparatus of the present invention.

In these figures, the shore ramp way in accordance with the present invention is of a three-folded construction consisting of a folding type upper ramp 20*a*, an inclined intermediate ramp 20*b*, and a lower ramp 20*c* placed on the quay, which are pivotally connected with hinges 21. The floor of the upper ramp 20*a* is provided with a turntable 22 and a driving means 23 for the turntable 22. Reference numeral 24 denotes a ramp driving means. In loading cars, the upper ramp 20*a* is supported at the horizontally extended position by wires 26 via blocks 25 installed at the ship side. When the car loading operation is completed, the intermediate ramp 21*b* and the lower ramp 21*c* are folded over the upper ramp 21*a*, which is pulled up by the wires 26 with a winch 27, so that the loading port is closed via not illustrated seal to provide watertightness.

When the stored cars A are unloaded, the driver feels the contact of rear wheel a with a wheel stop 22*a* installed on the turntable 22 on the upper ramp 21*a*, and then applies the brake, so that the car stops immediately. After the car stops, a worker presses the button to turn the turntable 180 degrees so that the car faces in the forward direction.

Figure 24:
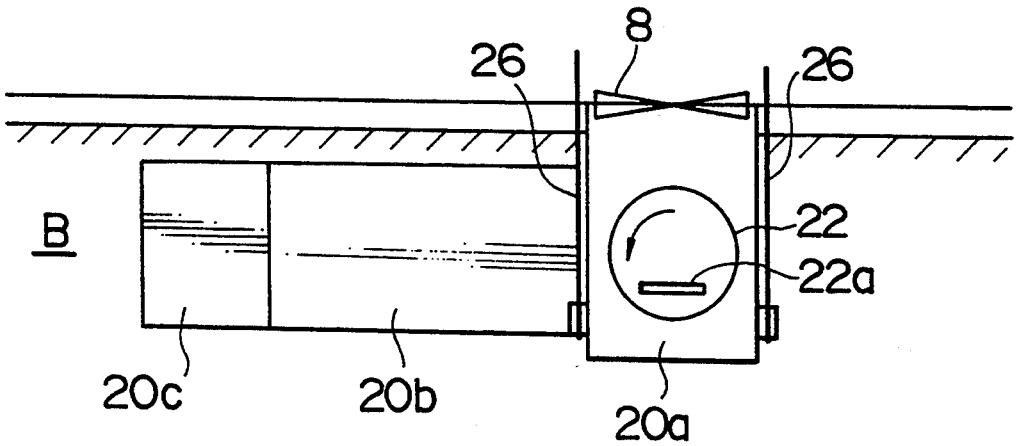
FIG. 24 is a plan view showing a modification of the shore ramp shown in FIG. 22.
Figure 25:
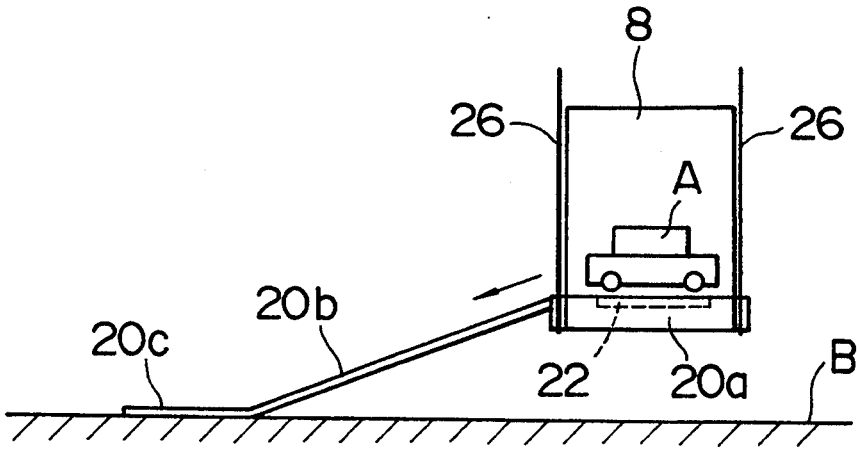
FIG. 25 is a front view of the shore ramp shown in FIG. 24.

After the turntable has been turned 180 degrees, the car runs forward onto the quay through the intermediate ramp 20*b* and the lower ramp 20*c*. As shown in FIGS. 24 and 25, the turntable can be turned 90 degrees automatically. This turning is sometimes convenient for drive-on/drive-off of cars depending on the relation with the space on the quay.

This construction of ramp offers the following effects:

(1) Since the direction of car can be changed on the ramp even when the direction of car cannot be changed in the ship and the car is driven out of the ship with reverse gear, the car can be driven safely and rapidly on the ramp.

(2) Since the turntable is installed on the folding type upper ramp, not on the car deck, the car deck is fully used for the storage of cars.

(3) A construction is possible in which the intermediate ramp is pivotally mounted to the side end of the upper ramp, and the turntable is turned, for example, 90 degrees instead of 180 degrees.

According to this embodiment, in the folding type shore ramp consisting of the upper ramp which can be folded to close the loading port installed on the side shell, an intermediate ramp whose upper end is hingedly connected to the upper or side end of the upper ramp, and a lower ramp which is hingedly connected to the lower end of intermediate ramp, the upper ramp is provided with the turntable for changing the direction of car 180 or 90 degrees. Therefore, this embodiment provides an economical shore ramp way for car carrier which can unload many cars safely and rapidly without the decrease in loadage of car carrier. Thus, this embodiment is very useful in the industry.

We claim:

1. A car storage apparatus in an automative car carrier ship, said carrier having a plurality of car storage decks, comprising:

a car loading port installed at the ship side on one of the decks;

a loading/unloading berth extending from and permitting movement of a car from said loading port into the ship;

elevator shafts extending vertically through said car storage decks;

a lifter disposed in each elevator shaft for movement between said car storage decks with a car being mounted thereon; and conveyor means installed on said loading/unloading berth, lifters, and car storage decks, for transferring a car between said berth, said lifters and said car storage decks.

2. A car storage apparatus according to claim 1, further including a turntable having a conveyor thereon installed on said loading/unloading berth.

3. A car storage apparatus according to claim 1, further including wheel stops installed at both sides of the conveyor means on said car storage deck to abut against the front and rear wheels of a car from the outside, said wheel stops being connected to an independent hydraulic cylinder, which is connected to a common hydraulic regulator, and a valve is installed in a pipe between said hydraulic cylinder and said hydraulic regulator to stop the supply of pressure oil from said hydraulic regulator to each of said hydraulic cylinder at the same time.

4. A car storage apparatus according to claim 1, said conveyor means on said car storage deck is comprised of two sets of two-row conveyors, said two sets of conveyors being arranged at an interval equal to the wheel base of car and being inclined in a V shape to accommodate the wheel of car.

5. A car storage apparatus according to claim 1, wherein the conveyor means on said car storage deck has ridges installed at positions near the edge of car mounting surface at an interval nearly equal to the wheel base of car, the opposing surfaces of ridges being formed so as to open outwards and upwards.

6. A car storage apparatus according to claim 1, wherein a width of said conveyor means on said loading/unloading berth is formed so as to be smaller than the distance between the wheels of car, and a pair of vertically movable floors are installed at both sides of said conveyor means at an interval nearly equal to the wheel base of car, by which a car is mounted on said movable floors and then the bottom of car is mounted on said conveyor means by lowering the movable floors.

7. A car storage apparatus according to claim 1, wherein an upper ramp is installed on the ship side shell to open/close said car loading port, said upper ramp being held horizontally when being turned down and having a turntable for changing the direction of car.

* * * * *